United States Patent [19]

London et al.

[11] 4,300,688

[45] Nov. 17, 1981

[54] COMPACT MERCHANDISING PACKAGE OF A FLEXIBLE GARMENT BAG AND COLLAPSIBLE HANGER

[75] Inventors: Wallace London, 641 S. Monroe St., Baltimore, Md. 21223; Kurt L. Meyer, Ellicott City, Md.

[73] Assignee: Wallace London, Baltimore, Md.

[21] Appl. No.: 140,846

[22] Filed: Apr. 16, 1980

[51] Int. Cl.[3] ..... B65D 85/18

[52] U.S. Cl. ..... 206/286; 206/285; 223/94

[58] Field of Search ..... 206/286, 278, 279, 284, 206/288, 297, 299, 285; 223/85, 87, 94

[56] References Cited

U.S. PATENT DOCUMENTS

| | | | |
|---|---|---|---|
| 1,731,414 | 10/1929 | Grossman | 206/299 X |
| 2,478,590 | 8/1949 | McKnelly et al. | 223/94 |
| 3,566,456 | 3/1971 | London | 206/285 X |

*Primary Examiner*—Steven M. Pollard

*Attorney, Agent, or Firm*—Samuel Lebowitz

[57] ABSTRACT

An improved merchandising package for a foldable flexible garment bag permitting individualized compact packing and storing thereof and incorporating therein an inexpensive disposable hanger to enable the convenient and ready demonstration of the function, utility and advantages of the garment bag.

5 Claims, 10 Drawing Figures

Fig. 1
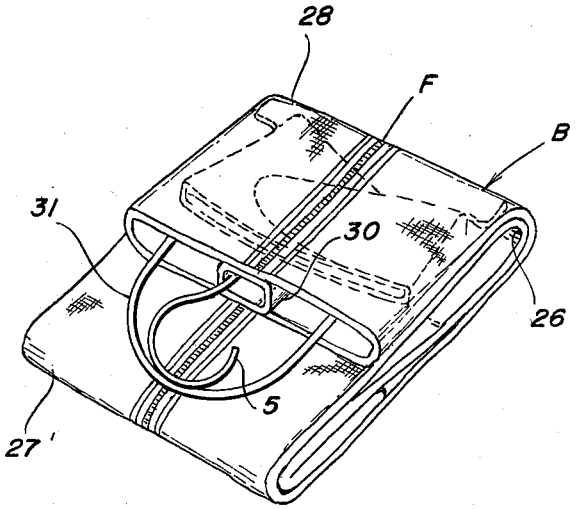
Fig. 2
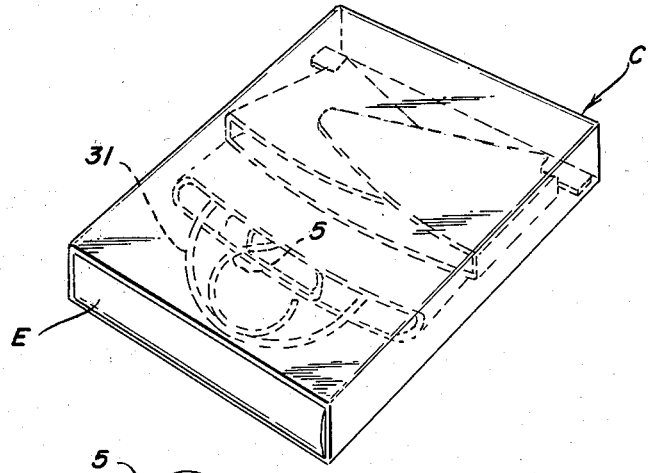
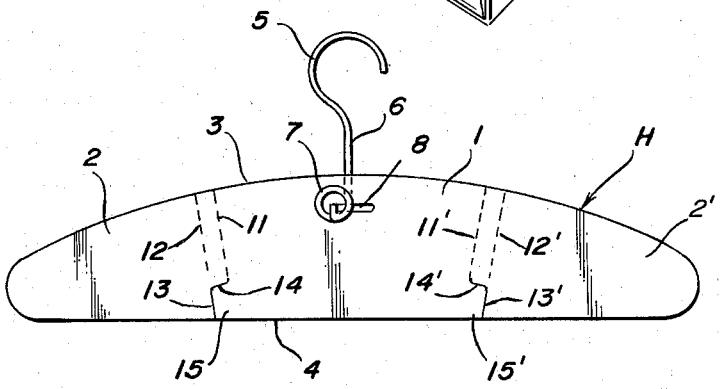
Fig. 4
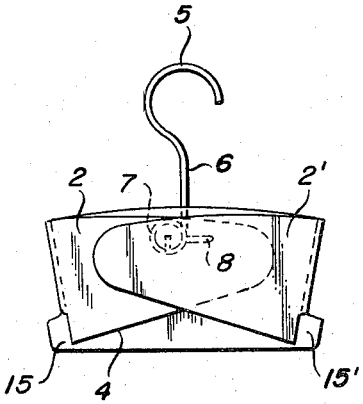
Fig. 3

Fig. 5
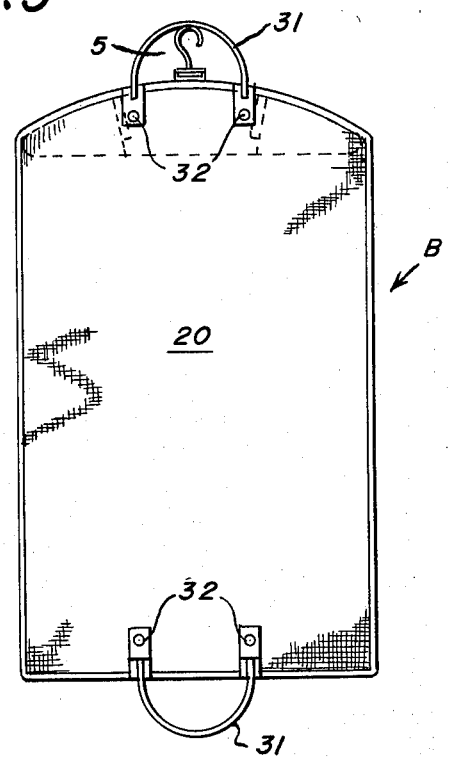
Fig. 6
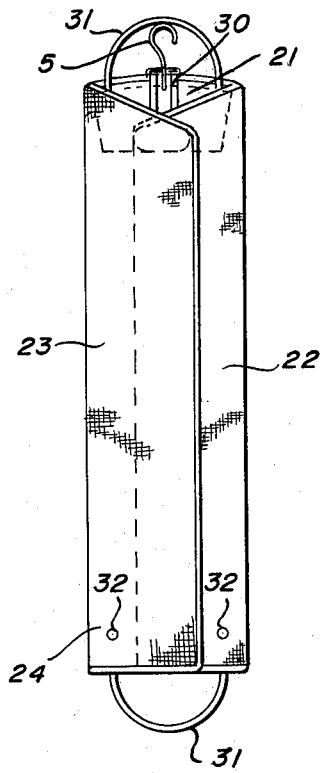
Fig. 7
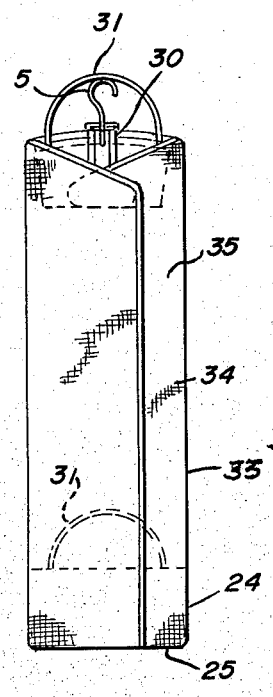
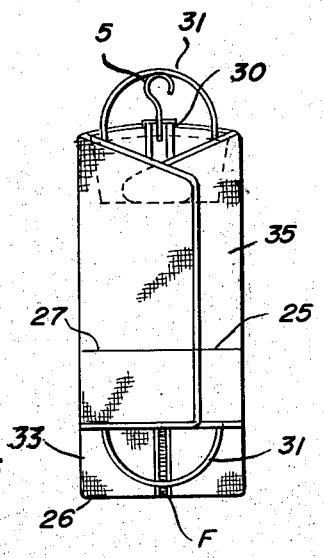
Fig. 8
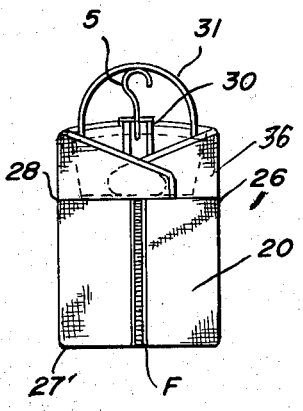
Fig. 9
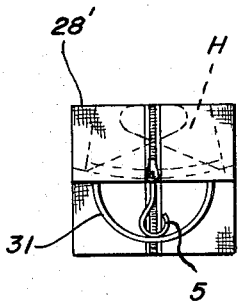
Fig. 10

COMPACT MERCHANDISING PACKAGE OF A FLEXIBLE GARMENT BAG AND COLLAPSIBLE HANGER

This invention relates to a compact merchandising package comprising a flexible garment bag and a foldable garment hanger in conjunction therewith.

It is the object of the present invention to provide an economical package of a folded garment bag and a low-cost disposable foldable garment hanger, which permits a convenient and ready demonstration of the former at the point of sale to demonstrate the function, utility and advantages of the garment bag of special construction.

It is a further object of the invention to provide a low-cost disposable garment hanger for use in conjunction with a merchandising package for a flexible garment bag with a special jointed clamp which has a special cooperation with the wire hook portion of the hanger.

Other objects and purposes will appear from the detailed description of the invention following hereinafter, taken in conjunction with the accompanying drawings wherein FIG. 1 is a perspective view of the flexible garment bag having a foldable hanger in conjunction therewith, preparatory to the packaging thereof for transport, distribution and sale;

FIG. 2 is a perspective view of the combination shown in FIG. 1, inserted in a cardboard carton;

FIG. 3 is a front elevation of the foldable garment hanger within the confines of the folded garment bag;

FIG. 4 is a front elevation of the foldable garment hanger in extended position for demonstration of the garment bag, if such is desired;

FIG. 5 is a rear view of the garment bag preparatory to the folding thereof into the compact package shown in FIGS. 1 and 2; and FIGS. 6 to 10 illustrate the successive stages of folding of the garment bag from the position shown in FIG. 5 to that shown in FIGS. 1 and 2.

The garment bag of the instant invention is of the type illustrated in the patent of one of the co-inventors herein, namely, Wallace London, U.S. Pat. No. 3,566,456, Mar. 2, 1971, which bag features a jointed clamp at the top thereof for embracing the upper wire portion of garment hangers which protrude exteriorly of the bag for support from a rod, hook, or the like. This construction of the bag has met with wide commercial success. In order to maintain the bags in clean condition in the course of transport, distribution and storage, such are packaged in individual cartons, with the identification of the color and/or style of the bag imprinted on the outside of the cartons.

At the point of sale, it is sometimes desirable that the function, and mode of operation of the bag be demonstrated, which requires a hanger with a wire upper portion for this purpose, and if this is not readily available, the loss of a sale may be a consequence. For this reason, it is highly desirable that the package include a low cost hanger which may be used for such a demonstration and which is designed to be folded within the relatively small areas of the folded garment bags.

It is well known that garment bags provided with hangers on the interior thereof have been used for many decades and U.S. Pat. No. 2,154,630, Apr. 18, 1939, is illustrative of such. Furthermore, telescopic and/or foldable hangers which may be folded and/or broken down into two or more parts, are also old in the art. However, no one has provided a combined hanger and folded garment bag to enhance the merchandising of the latter, as embodied in the instant invention.

A preferred embodiment of the hanger H forming part of the improved package disclosed herein is shown in FIGS. 3 and 4 of the drawings and is constituted by a central portion 1 with lateral wing portions 2 and 2' extending from the opposite sides thereof and which are separated by spaced score lines 11-12 and 11'-12', respectively. The spaced score lines permit the alternate folding of the hanger from the position shown in FIG. 3 to the extended position shown in FIG. 4 wherein the three foldable parts form a continuous convexly curved upper edge 3 and a substantially horizontal edge 4. The score lines do not extend completely from the upper edge 3 to the bottom edge 4, and angular incisions 13 and 14 at the lower edge of incisions 11-12, and 13'-14' at the lower ends of incisions 11'-12' form projections 15,15' from the opposite sides of the central section which, together with the converging angularity of the score lines permit the complete folding of the wings 2,2' within the area of the central section 1.

The hanger H, which is preferably formed of cardboard, is provided with an opening 8 which may be of elongate or circular outline to accommodate the lower end of a wire stem 6 having an engaging or clamping terminal 7 at the lower end thereof for embracing the opposite sides of the cardboard sheet or otherwise engaging the central portion of the hanger. A hook portion 5 extends from the upper portion of the stem 6 for protrusion beyond the opening in the top of the bag whereat is fixed the jointed clamp 30 (FIG. 6). The clamp 30 embraces the stem 6 of the hanger while the hook 5 is adapted for support from an external bar or hook to prevent the hook portion from falling into the bag and possibly causing damage to the garments in the interior thereof, all as fully disclosed and described in detail in the above-mentioned patent to London.

The utility and advantages of the garment bag, and the differences in its mode of operation from others, are not always comprehensible to a purchaser and the inclusion of a garment hanger in the package clarifies this, which may be supplemented by either printed instructions or a demonstration by the salesperson.

While the garment bag may be handled by grasping one or more of the hooks 5 of the hanger protruding therefrom, the bag B may be provided with looped handles 31 affixed to the opposite ends of rear face 20 of the bag by means of rivets 32.

In FIG. 5 is shown the bag with the foldable garment hanger therein preparatory to its folding into the small area shown in FIG. 1 with the hanger within the bag presenting no impediment to such folding.

With the rear face 20 of the bag uppermost and the zipper fastener F in the front face therebelow, the lateral margins 22 and 23 of the bag are folded in overlying relation, as shown in FIG. 6 to reduce the lateral expanse of the bag to slightly more than one-third thereof. A series of transverse folds are then made in the transition thereof to the condition shown in FIG. 1. Thus, the lowermost portion 24 of the bag is folded rearwardly along fold 25 as shown in FIG. 7. The lowest intermediate portion 33 together with the juxtaposed bottom portion 24 are then folded forwardly along fold 26. This is shown in FIG. 8.

The three juxtaposed panels 24,33 and the central intermediate portion 34 are then swung forwardly around inner fold 27 in superposing relation to the uppermost intermediate portion 35 of the bag to form the lower edge of the package at external fold 27', as shown in FIG. 9. The topmost portion 36 of the bag with handle 31 and hook 5 is swung downwardly along inner fold 28 to attain the final stage of the folding as shown in FIG. 10, wherein the outer edges 27' and 28' define the external boundaries of the package. This is of sufficiently small area to be confined within a cardboard carton C, as shown in FIG. 2.

The closure flap E of the carton may bear printed information regarding the color and style of the garment bag, so that the containers may be stacked conveniently for ready identification of the contents thereof.

If desired, the folded garment bag with hanger therein may be inserted in either cardboard containers provided with plastic windows, or envelopes formed of plastic or paper, all of which will maintain the contents clean during transport and/or storage.

We claim:

1. A foldable garment hanger for combination with a flexible garment bag to constitute a merchandising package for the latter and adapted for ready demonstration of the mode of functioning of the garment bag, said hanger being formed of a readily disposable body of cardboard with wire hook suspension means detachably connected to said body, said body comprising a central section and lateral wings extending from the opposite sides thereof with spaced score lines between said section and wings to permit the transverse folding of the lateral extremities of the garment bag in superposition with the central portion of the bag, while permitting the spreading of the wings when the garment bag is fully extended in position for support by the wire hook projecting through an opening at the upper end thereof.

2. An assembly as set forth in claim 1, wherein said last mentioned opening in the garment bag is constituted by a jointed clamp adapted to embrace at least one wire suspension means of a garment hanger adapted to be contained within said garment bag.

3. A merchandising package of a folded flexible garment bag embodying a jointed clamp at the upper end thereof having a pair of jaws pivoted on a horizontal axis for embracing the wire suspension means of a garment supporter, comprising (a) a container for said garment bag of limited surface area requiring the multiple folding of the bag for accommodation within said container, the width of said container being slightly larger than a third of the width of said garment bag to permit the storage of the latter when the opposite lateral margins of the bag are folded longitudinally in overlying relation to the central portion of the bag with the width of the latter being of the same order as that of the margins, (b) a collapsible garment supporter with wire suspension means adapted to assume alternate positions in a folded inoperative state and in an extended operative position, (c) said garment supporter comprising a readily disposable sheet of cardboard having a convexly curved upper edge and a substantially horizontal bottom edge, spaced scoring lines extending from the upper edge of said sheet on each side of the central median of the latter to subdivide said sheet into a central portion and lateral wing portions adapted to be folded into overlying relation with said central portion and to fit within said container in its folded inoperative state and to assume a position for support by said jointed clamp in its extended operative position to provide ready availability of a garment supporter for demonstrating the functioning of the flexible garment bag.

4. An assembly as set forth in claim 3, wherein said scoring lines are each inclined at a small angle to the vertical towards said central median and terminate in incisions adjacent to the bottom edge to facilitate the folding of the wing portions entirely within the boundaries of said central portion of said sheet.

5. An assembly as set forth in claim 4, wherein said garment supporter is disposed within the top of said garment bag with the folded wing portions of the garment supporter within the lateral folds of the bag and the wire suspension means thereof extending through the clamp.

* * * * *